US008057010B2

(12) United States Patent
Puigardeu et al.

(10) Patent No.: US 8,057,010 B2
(45) Date of Patent: Nov. 15, 2011

(54) METHOD AND PRINTER FOR MULTI-PASS PAGE-WIDE ARRAY PRINTING

(75) Inventors: Sergio Puigardeu, Barcelona (ES); Alex Andrea, Barcelona (ES); David Gaston, Barcelona (ES); Joan Joroa, Barcelona (ES); Angel Martinez, Barcelona (ES); Silvia Miramanda, Barcelona (ES); Ramon Vega, Sabadell (ES); Jordi Sender, Barcelona (ES); Marti Rius, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 533 days.

(21) Appl. No.: 12/240,305

(22) Filed: Sep. 29, 2008

(65) Prior Publication Data

US 2009/0128599 A1 May 21, 2009

Related U.S. Application Data

(60) Provisional application No. 60/988,612, filed on Nov. 16, 2007.

(51) Int. Cl.
*B41J 23/00* (2006.01)

(52) U.S. Cl. ..... 347/37

(58) Field of Classification Search ..... 347/12, 347/13, 37, 40–42
See application file for complete search history.

(56) References Cited

U.S. PATENT DOCUMENTS 6,938,970 B2 * 9/2005 Van den Bergen ..... 347/13
2004/0021732 A1 2/2004 Borgen

* cited by examiner

*Primary Examiner* — An Do

(57) ABSTRACT

A method of printing an image on a substrate using a page-wide-array printer and a page wide array printer is provided. The method includes printing a first portion of the image as relative movement occurs between the substrate and the print heads, and printing a second portion of the image as relative movement occurs between the substrate and the print heads, such that there exists an area of overlap between the first portion of the image and the second portion of the image. The substrate may be moved in a first direction relative to the print heads whilst the first portion of the image is printed, moved in a second direction opposite to the first direction; and moved in the first direction again whilst the second portion of the image is printed. The substrate may be printed whilst the substrate is moved in the second direction.

20 Claims, 4 Drawing Sheets

METHOD AND PRINTER FOR MULTI-PASS PAGE-WIDE ARRAY PRINTING

CROSS REFERENCE TO RELATED APPICATIONS

This Application claims the benefit of provisional patent application Ser. No. 60/988,612, filed Nov. 16, 2007 "METHOD AND PRINTER FOR MULTI-PASS PAGE-WIDE ARRAY PRINTING" which application is incorporated by reference herein as if reproduced in full below.

FIELD OF THE INVENTION

The invention relates particularly, but not exclusively, to methods for multi-pass printing in page-wide array printers, and to page-wide array printers.

BACKGROUND

In general, a page-wide array printer comprises a substrate transport path and a print head or array of print heads extending the full width of the substrate transport path. Such an arrangement allows the entire width of a substrate to be printed simultaneously. A substrate may be any sort of sheet-like medium, including paper, cardboard, plastic and textile.

The print head or array of print heads is usually fixed within the printer, and a substrate on which an image is to be printed is moved past the print head or heads along the substrate transport path. A complete image is often printed in a single printing pass.

In such single-pass printing image quality may sometimes be limited. For example, if the image requires a large amount of ink to be transferred to part or all of the substrate, that part of the substrate may warp or become deformed due to receiving a high flow of liquid ink in a short time. It is also possible that ink from adjacent print head nozzles may coalesce, causing the image to become blurred, or to appear grainy. It can be difficult to achieve detailed images that are also sharp in single-pass print-modes.

SUMMARY OF THE INVENTION

According to an embodiment of the invention, a method of multi-pass printing and a page-wide array printer are provided as described in the appended claims.

BRIEF DESCRIPTION OF THE DRAWINGS

The invention will now be described, by way of example only, with reference to the accompanying drawings:

FIG. 1 shows schematically a page-wide array printer 1. The printer 1 comprises a print head array 3 on which one or more print heads 5 are mounted. The print head array may comprise a plurality of print heads, such as in of the order of five, fifty, one hundred, or even more. In some embodiments each print head of the array may be about 1 inch long. In some embodiments the array may comprise only a single print head that is substantially the same length as the array.

Figure 1:
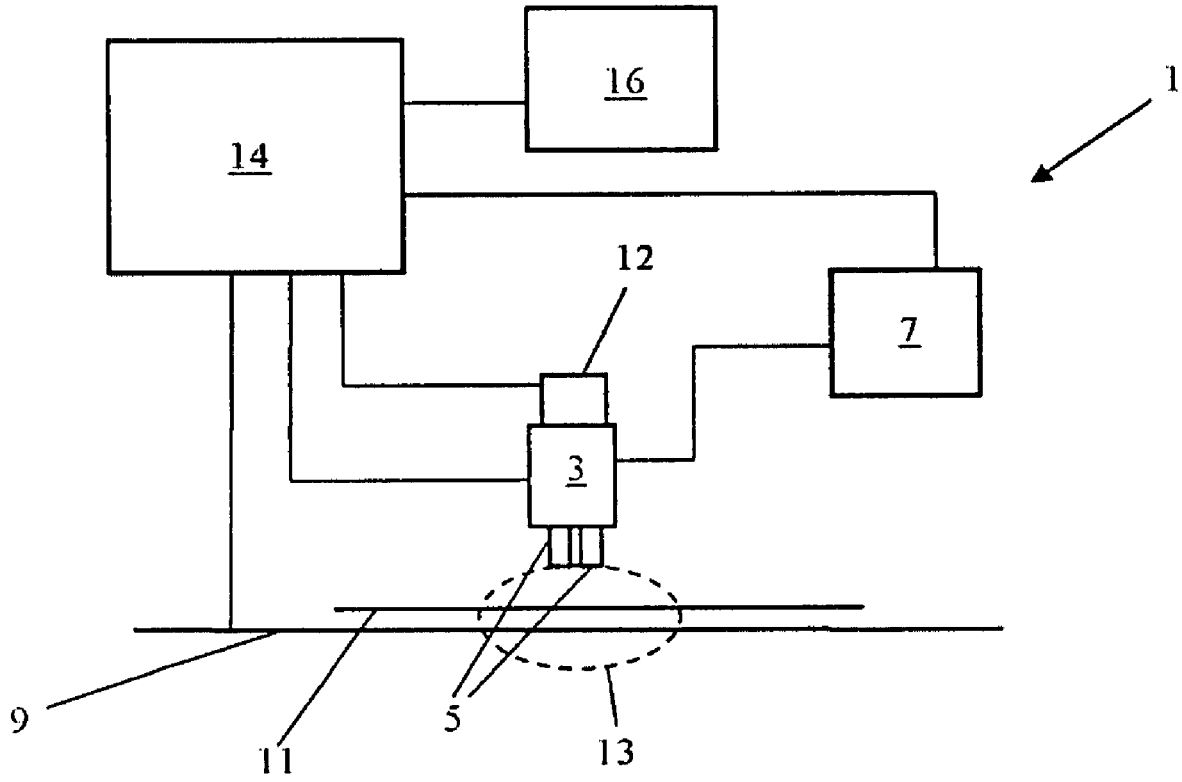
FIG. 1 is a schematic view of a page-wide array printer according to one embodiment of the invention.

Ink is supplied to the print heads 5 in the array 3 from an ink tank 7. The printer may comprise a print head array 3 for each colour or type of ink to be printed, each colour having its own ink tank. However, for clarity, only one print head array is shown in the Figures.

Each print head comprises a number of nozzles (not shown). The number of nozzles in this embodiment may be in the region of a hundred, five hundred, one thousand, or more. The structure of the print heads and nozzles in this particular embodiment is conventional, and will not be described in detail.

The printer 1 further comprises a substrate transport mechanism 9 which in use is operative to transport a substrate 11 to be printed upon through a print zone 13 below the print head array (or plurality of arrays) 3. The substrate transport mechanism 9 is operable to transport substrate through the print zone 13 in a least two different directions, as described in more detail below.

The printer further comprises a print head array transport mechanism 12 operative to move the array 3 slightly (for example, by a distance that is at least greater than the width of a single nozzle, but not so great that the array can no longer print the full width of a page being carried beneath it) in a direction substantially parallel to the longitudinal extent of the array, or at least in a direction having a component parallel to the longitudinal direction of the array.

A printer controller 14, such as a microprocessor, for example, is operative to control the firing of the nozzles and the movement of the substrate through the print zone 13. The printer controller also controls the supply of ink to the print heads 5 from the ink tank 7 and the movement of the array by array transport mechanism 12. It will be appreciated that although one controller is shown, separate controllers could instead be provided for each of the substrate transport mechanism 9, the print heads 5, and the ink supply from a plurality of tanks 7.

The controller has access to a memory 16 (for example a computer memory such as a solid-state RAM). Images or jobs for the printer to print are stored in memory 16 until they have been printed onto a substrate by the printer.

Figure 2:
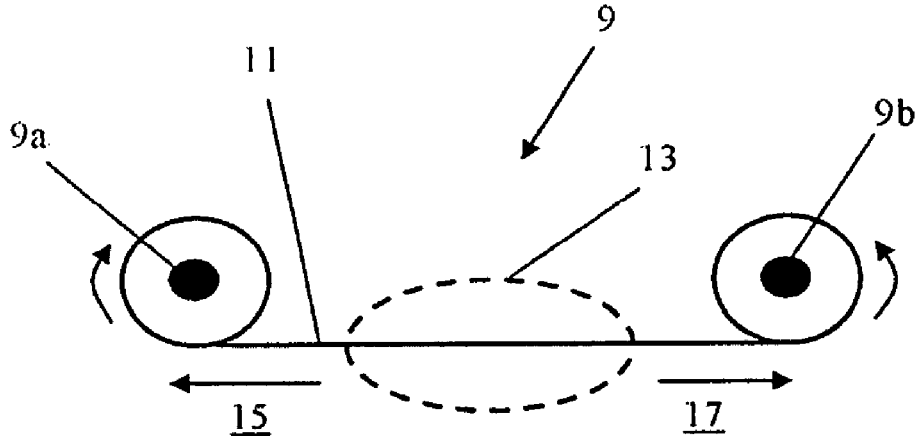
FIG. 2 is a schematic view of one embodiment of a substrate transport mechanism suitable for use in the printer of FIG. 1.

FIG. 2 shows the substrate transport mechanism of FIG. 1 in more detail. The transport mechanism 9 comprises two rollers, 9*a* and 9*b* onto which substrate 11 is wound. The first roller 9*a* can be turned to pull substrate from the second roller 9*b* through the print zone 13 in a first direction, indicated by arrow 15. The second roller 9*b* can be turned to pull substrate from the first roller 9*a* through the print zone 13 in a second direction, indicated by arrow 17, opposite to the first direction. Thus media can be moved beneath the print heads 5 in both the first direction and the second direction.

A multi-pass method of printing an image in accordance with the invention will now be described with reference to FIGS. 3 and 4.

The method comprises printing a first portion or swath of an image as the substrate passes beneath the print head or print head array 3 in the first, forward, direction 15, as the substrate is wound onto the roller 9*a* of the substrate transport mechanism 9. The substrate is then retracted back past the print head or array by rolling the substrate onto roller 9*b* of the substrate transport mechanism, the substrate moving in the second, opposite, direction. The substrate moves back a distance d1 in the reverse direction. The method then continues, as the substrate is carried a distance d2 beneath the print heads in the first direction 15 again, by printing a second swath of the image, which overlaps the first swath and extends beyond the first swath. The area of overlap is thus printed on twice (at least), rather than only once.

A third portion or swath is subsequently printed, overlapping with the second swath, and a fourth swath overlapping the third swath, and so on. The complete image is built up from the combined areas of overlap.

Figure 3:
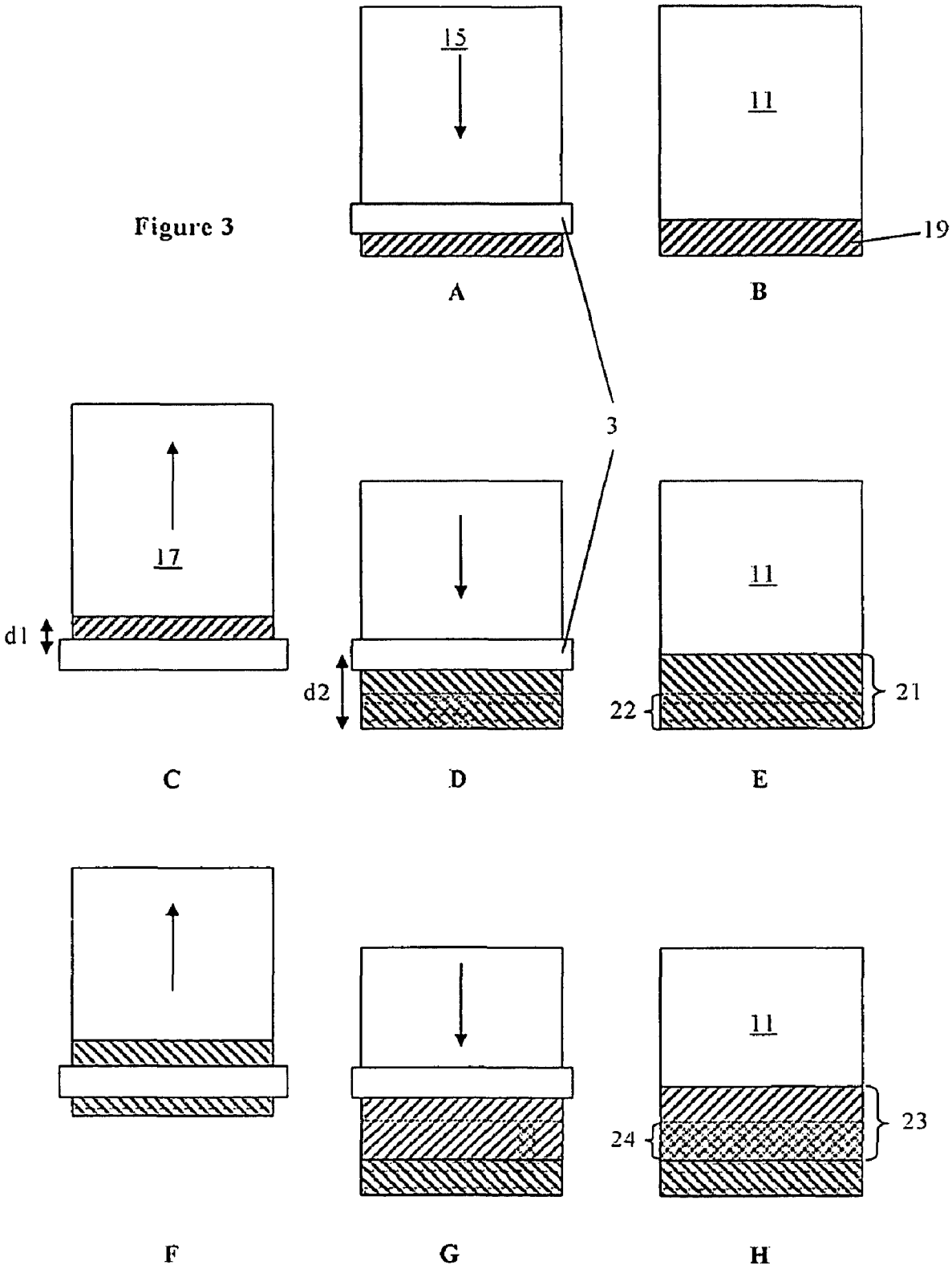
FIG. 3 schematically depicts one embodiment of a multi-pass print-mode method.

The distances 'd1' and 'd2' shown in FIG. 3 can vary, and may be larger or smaller than the distances shown in FIG. 3.

'Portion' is herein used to mean a part of an image that is less than the whole image, and does not refer to the amount of ink used when printing (that is, the entire image printed using less than all the ink specified for that image is not a 'portion' of image within the meaning of this specification).

Referring to diagram A of FIG. 3, the substrate 11 is moved in the first direction 15 relative to the print head array 3 whilst a portion 19 of the image is printed in a first printing pass. That first portion 19 is indicated by upward diagonal lines, and is more clearly visible in diagram B, which corresponds to diagram A in which the array 3 has been removed for clarity. The substrate 11 is then moved in a second direction 17 opposite to the first direction, as shown in diagram C. Then, shown in diagram D, the substrate is again moved in the first direction whilst a second portion 21 of the image is printed in a second printing pass. In diagram E, which corresponds to diagram D with the print head array 3 removed, the second portion 21 can be seen more clearly, represented by downward diagonal lines. The area of overlap 22 between first and second portions 19 and 21, shown by crosshatching, has now been printed upon twice, in both the first printing pass and the second printing pass.

The substrate is then withdrawn again in direction 17, as shown in diagram F. Then, in a third printing pass (shown in diagrams G and H), a third image portion 23 is printed, extending from the edge of the first portion 19 and overlapping the second portion 21 in crosshatched area 24, so that the area 24 has also been printed on twice.

It will be appreciated that the steps shown can be repeated, by moving the substrate forwards and backwards in steps, any number of times in order to build up a complete image. With the exception of the first and last portions of image printed, each portion of image is printed such that there exists an area of overlap between that portion of image and an already printed portion of the image.

Each area of overlap is printed twice (or more times, as described in more detail below), in each printing swath, less than the full amount of ink required to be transferred to the paper to form the image is used. A proportion, for example half, or a third, or a quarter, of the ink required to make up the complete the image may be printed in the first printing pass. Alternatively, if the image is intended to be made up from more than one type or colour of ink (such as the usual four colours, yellow, cyan, magenta and black), less than all the colours or types, for example only one colour, may be printed in the first swath. In the second swath, the remaining proportion of the ink may be printed, so that the area of overlap then has been printed with the total amount of ink making up that portion of the image. The printer controller 14 controls the colour and amount of ink that is printed during each printing pass.

In the example shown in FIG. 3, with the exception of the first portion, each portion of the image is printed as the substrate is moved a distance of 2n in the first direction 15. The substrate is then moved a distance of n in the second, opposite, direction, before a subsequent overlapping portion is printed as the substrate is moved a distance of 2n in the first direction. The steps of retracting the substrate a distance of n and printing a distance of 2n are repeated over and over again until the end of the image is reached.

The distance that the substrate is moved is different, in the example of FIG. 3, at the beginning and end of printing, to ensure that the start and end of the image are printed on the same amount of times as the remainder of the image. At the start of printing any given image, the initial portion of image 19 is completely included within the second portion of image. At the end of printing, the final portion of image does not extend beyond the penultimate portion of image, and is completely included within that penultimate portion. However, it will be appreciated that where two or more images are printed one after the other, it is instead possible to continue stepping the substrate by the same distance (eg 2n) by allowing the final portion of one image to be printed in the same printing pass as the first portion of the following image.

It will be appreciated that each area of overlap may be printed on more than two times. Each area of overlap may be printed on three, four or five limes, or even more. For example, the method may print four steps forward, followed by taking three steps back, and printing a further four steps forward. In that case, each portion of the image will be printed three times. Following the printing of the second swath, a third swath is printed, and then a fourth. In such a three-pass embodiment; the third swath overlaps rather than abuts the first swath, as well as overlapping the second swath, and the fourth swath overlaps both the second and third swaths, and so on.

This can be expressed more generally by ensuring that any given 'first portion' of the image is printed as the substrate is moved a distance of n in the first direction; the substrate is then moved a distance of (n−x) in the second direction; and that the subsequent portion is printed as the substrate is moved a distance of n in (he first direction. 'n' and 'x' can be any real numbers, where $x<n$ (for example, $n=4$ and $x=3$, as mentioned above).

The movement of the substrate by the transport mechanism 9 is controlled precisely by the controller 14 in order to ensure that each portion is printed at the correct desired location. A subsequent portion is ideally precisely in register with the portion it is overlapping in order to achieve a sharp image that is not blurred. In addition, adjacent portions (such as the first and third) should ideally just touch (rather than overlap or be spaced apart) to ensure that the area where the two portions meet is not visible as a line in the final image. The value of x may be chosen so that $n/(n-x)$ is a whole number. If that is not the case then some areas of the image may be printed on in more passes than others.

Any proportion of the total ink required for the image may be printed in each swath, as long as the area of overlap between the swaths is printed with the required total amount of ink. For example, in a situation where each area of overlap is printed on by n swaths, each swath may print using substantially 1/n of the total ink volume to be transferred to the paper. Alternatively, the number of limes an area is printed may correspond to the number of colours or types of ink, and a different type of ink may be printed in each swath.

If one or more nozzles in the print head array misfires (which might occur when a nozzle becomes clogged or damaged) a line is formed in the image being printed, because the substrate beneath the misfiring nozzle is not primed correctly. In order to alleviate or compensate for this effect, the print head array transport mechanism 12 is operable to move the print head array laterally slightly between printing passes, for example, between printing the first portion and printing the second portion. The array is moved in a direction which is different to both the first and second directions 15 and 17, for example substantially parallel to the longitudinal extent of the array, to avoid any such line or lines being created by a potentially misfiring nozzle.

Figure 4:
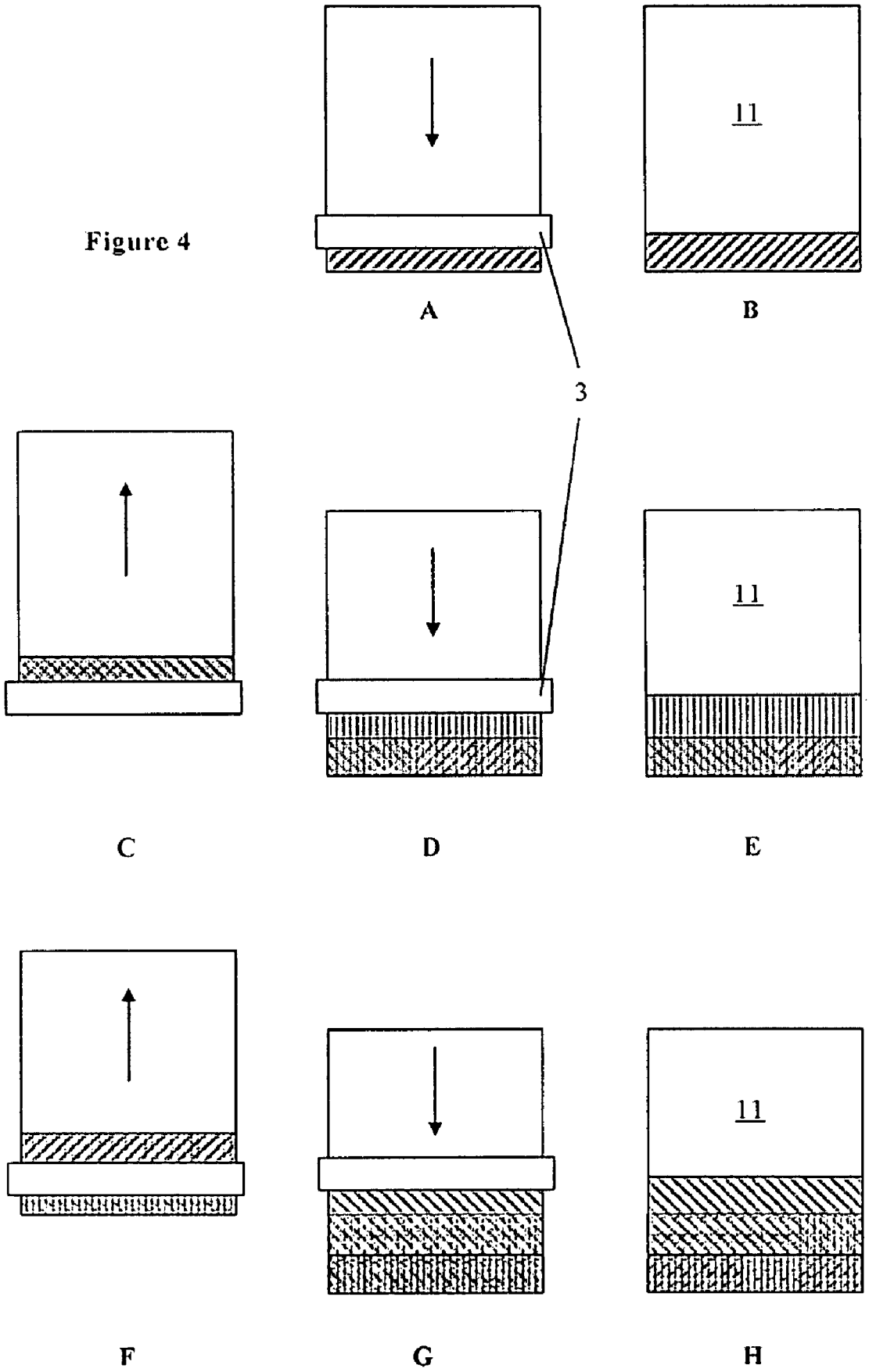
FIG. 4 schematically depicts an alternative embodiment of a multi-pass print-mode method.

In an alternative embodiment, depicted in FIG. 4, the substrate is additionally printed on whilst the substrate is moved in the second direction, as shown in diagram C of FIG. 4, before the substrate is printed on for the second time in the first direction, shown in diagram D of FIG. 4. In this embodiment, the substrate is still moved by the same distance (ie two steps forwards, one step backwards), but each area of substrate receives three coats of ink, allowing more ink to be applied to the paper in the same amount of time, increasing printing efficiency.

Figure 5:
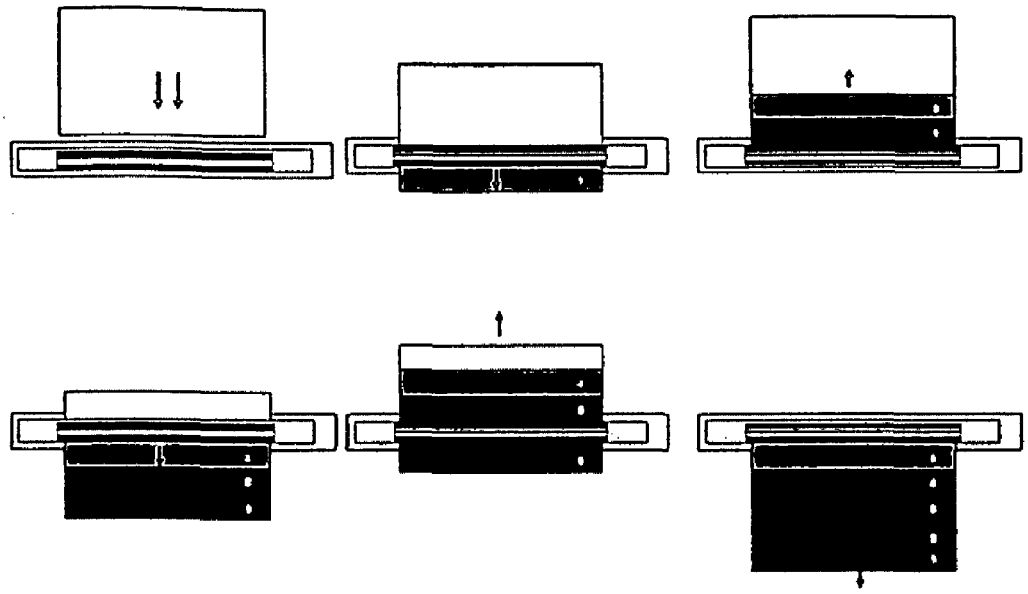
FIG. 5 is similar to FIG. 4, and depicts the method just before its completion.
Figure 6:
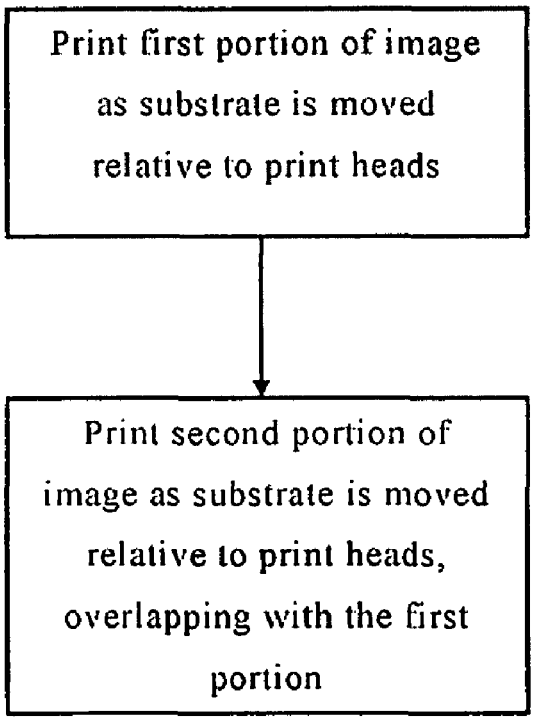
FIG. 6 shows a flow chart setting out the steps of a method of printing according to an embodiment of the invention.

FIG. 5 is similar to FIG. 4, and depicts the method when the penultimate swath of an image has just been printed.

As described above with respect to FIG. 3, by varying the distance the substrate is moved during each printing pass, it is possible to arrange the printer such that the each area of substrate is printed on in more than three passes, and any proportion of the total ink may be printed in each pass. For example, in a printer arranged to move the substrate four steps forward and three steps back, the substrate will be printed on five times.

A multi-pass print mode in accordance with the invention allows less ink to be applied to the paper in each printing pass. Decreasing the ink flow has the effect of increasing image quality, by reducing nozzle firing frequency issues (ie each nozzle has more time, because there are more printing passes, to apply the amount of ink that it needs to), and reducing grain and coalescence. Aerodynamic effects are also reduced, as decreasing ink flux reduces the possibility that ink firing might create perturbations in the air that could disturb the firing of adjacent nozzles. The method allows the printer to run at lower temperature (as nozzles are generally firing less often), which increases print head reliability. In addition, higher optical density images can be produced, as more ink overall can be applied to the paper during multiple passes than in a single pass.

It is possible to provide a multi-pass print-mode in a printer which is only able to transport a substrate in a single direction by printing an image using a fraction of the total ink required for that image. The substrate could then be withdrawn from the printer to allow the complete image to be reprinted on the same substrate using the remainder of the ink. However, with such a method it is very difficult to line the substrate up on the second pass to ensure that the second printed image is precisely in register with the first. It is also possible for a substrate to change shape (eg shrink or warp) after ink has been applied, and if that occurs it may be impossible to get the second image in register with the first. Finally, the substrate may pass through an ink curing system of the printer after the first image is printed, meaning that the second image will be printed on top of cured ink. All of these issues can adversely affect image quality.

It is emphasised that in multi-pass print-modes in accordance with the invention, only a portion of the image, that is, less than the full image, is printed in each printing pass. In some embodiments, as the substrate is only moved a small distance relative to the length of the substrate between each printing pass it is easier to precisely locate the substrate between printing passes, making it easier to get the image portions in line with each other. It also means the ink has less time to dry, or to warp the substrate, between each printing pass. Second and subsequent portions are also not printed on top of cured ink, allowing good quality images to be achieved.

It will be appreciated that other embodiments may transport the substrate in a different manner to that shown in FIG. 2. For example, a substrate may be carried on a drum, a belt, or a flat platen. Alternatively, the substrate may be stationary and the print head array may move over the substrate. Relative movement between the print head array 3 and the substrate to be printed upon in first and second directions transverse to the longitudinal extent of the head array 3 is what is required.

The invention claimed is:

1. A method of printing an image on a substrate in multiple passes using a page-wide-array printer having an array of print heads, the method comprising the steps of:

printing, with an array of print heads of a page-wide array printer, a first portion of the image as relative movement in a first direction occurs between the substrate and the print heads;

causing a second relative movement between the substrate and the print heads in a second direction that is opposite of said first direction, a distance of said second relative movement being less than a length of said first portion, the length of the first portion being parallel to the direction of relative movement; and printing, with the array of print heads, a second portion of the image as relative movement occurs in the first direction between the substrate and the print heads, such that there exists an area of overlap between the first portion of the image and the second portion of the image.

2. The method of printing of claim 1 wherein:

a length of said first portion is equal to a length of said second portion.

3. The method of printing of claim 1 wherein the substrate is printed whilst the substrate is moved in the second direction.

4. The method of printing of claim 1 wherein the first portion is printed as the substrate is moved a distance of n in the first direction; the substrate is moved a distance of (n−x) in the second direction, where x<n; and the second portion is printed as the substrate is moved a distance of n in the first direction.

5. The method of printing of claim 4 wherein the substrate is printed as the substrate is moved the distance of (n−x) in the second direction.

6. The method of claim 1 wherein a beginning of the image is completed by printing the second portion so that the first portion is completely included within the portion and the second portion extends beyond the first portion.

7. The method of claim 1 wherein an end of the image is completed by printing a penultimate portion of the image and then printing a final portion of the image, wherein the final portion overlaps but does not extend beyond the penultimate portion is printed.

8. The method of claim 1 wherein the print head array is moved in a direction having a component parallel to an elongate length of the print head array between printing the first portion and printing the second portion, to alleviate the effect of one or more potentially misfiring nozzles in the print head array.

9. A page-wide array printer comprising an array of print heads, and a printer controller for printing an image on a substrate in multiple passes, the printer controller being operable to:

cause the print heads to print a portion of the image on a first area of the substrate while said print heads move a first direction relative to said substrate;

move said print heads in a second direction relative to said substrate for a first distance, said second direction being opposite of said first direction, said first distance being less than a length of said first area, the length of the first area being parallel to said first direction; and print a portion of the image on a second area of the substrate while said print heads move in the first direction relative to the substrate, the second area overlapping the first area of the substrate, and also extending to a region of the substrate adjacent the first area, but not included in the first area.

10. The printer of claim 9 wherein the controller is operative to cause a beginning of the image to be completed by printing the portion on the second area so that the portion printed on the first area is completely included within the portion printed on the second area and the second area extends beyond the first area.

11. The printer of claim 10 wherein the controller is operative to cause the image to be completed by printing a penultimate area of the image and then printing a final area of the image, wherein the final area overlaps but does not extend beyond the penultimate area.

12. The printer of claim 11 wherein the controller is further operative to cause the print heads to print whilst the substrate is moved in the second direction.

13. The printer of claim 9 wherein the print head array has an elongate extent, and wherein the printer comprises a print head array transport mechanism operative to move the array in a direction having a component parallel to the longitudinal extent of the print head array between printing the first portion and printing the second portion, to alleviate the effect of one or more potentially misfiring nozzles in the print head array.

14. A method of multi-pass printing in a page-wide array printer having at least one print head or an array of print heads, the method comprising printing a first swath of an image as a substrate passes beneath the print head or heads in a first direction, retracting the substrate back past the print head or heads by a distance that is less that a length of the first swath in the first direction, and printing a second swath of the image as the substrate passes beneath the print head or heads in the first direction, the second swath overlapping the first swath and extending beyond the first swath in the first direction.

15. The method of claim 14 wherein a beginning of the image is completed by printing the second swath so that the first swath is completely included within the first swath and the second swath extends beyond the first swath.

16. The method of claim 14, further comprising, printing a third swath of said image while said array of print heads moves in said second direction relative to said substrate.

17. The method of claim 14, wherein the second swath extends beyond the first swath a distance that is equal to the distance retracted by the substrate past the print heads.

18. The method of claim 14, wherein a length of said second swath is equal to a length of said first swath.

19. The method of claim 14, further comprising, printing additional swaths of the image, each subsequently printed portion overlapping an immediately previous printed swath until said image is complete.

20. The method of claim 14, further comprising, moving said array of print heads in a third direction that is parallel to an elongate length of said array of print heads between moving said array in either said first or second direction relative to said substrate.

* * * * *

UNITED STATES PATENT AND TRADEMARK OFFICE

CERTIFICATE OF CORRECTION

PATENT NO. : 8,057,010 B2
APPLICATION NO. : 12/240305
DATED : November 15, 2011
INVENTOR(S) : Sergio Puigardeu et al.

It is certified that error appears in the above-identified patent and that said Letters Patent is hereby corrected as shown below:

ON THE TITLE PAGE
Item (75) Inventors: Inventor Joan Joroa should be Joan Jorba

Signed and Sealed this
Twentieth Day of December, 2011

David J. Kappos

David J. Kappos
*Director of the United States Patent and Trademark Office*